United States Patent [19]

Nava

[11] 4,297,747

[45] Nov. 3, 1981

[54] DEVICE TO ACTUATE HELMET VISORS, PARTICULARLY FOR MOTORCYCLISTS

[76] Inventor: Pier L. Nava, Verderio Superiore, Como, Italy

[21] Appl. No.: 125,986

[22] Filed: Feb. 29, 1980

[30] Foreign Application Priority Data

Jul. 27, 1979 [IT] Italy ..... 24747 A/79

[51] Int. Cl.[3] ..... A42B 3/02; A61F 9/00

[52] U.S. Cl. ..... 2/424; 2/10

[58] Field of Search ..... 2/424, 10, 6, 8, 9

[56] References Cited

U.S. PATENT DOCUMENTS

| | | | |
|---|---|---|---|
| 3,568,211 | 3/1971 | Petruzella, Jr. | 2/6 |
| 3,636,565 | 1/1972 | Luisada et al. | 2/6 |
| 3,721,995 | 3/1973 | Peillex | 2/10 |
| 4,247,960 | 2/1981 | Nava | 2/424 |

FOREIGN PATENT DOCUMENTS

| | | | |
|---|---|---|---|
| 2326156 | 4/1977 | France | 2/424 |
| 2024927 | 1/1980 | United Kingdom | 2/10 |

*Primary Examiner*—Peter P. Nerbun

*Attorney, Agent, or Firm*—Stevens, Davis, Miller & Mosher

[57] ABSTRACT

A device presents a tube, fixed to the wall of a helmet and guides for a slide, which can be moved along said guides by means of a cable S.

The slide keeps hinged the visor B through a clutch connection, having a pinion which engages a rack 28D fixed to a support.

The movement of the slide in one direction X, at first releases the ends of the visor from the shoulder of the helmet and afterwards engages the pinion with the rack, and this induces a swinging movement of the visor B around its pivots.

12 Claims, 6 Drawing Figures

DEVICE TO ACTUATE HELMET VISORS, PARTICULARLY FOR MOTORCYCLISTS

DESCRIPTION

This invention relates to improvements in the invention disclosed in the basic U.S. patent application No. 973,719, now U.S. Pat. No. 4,247,960 relating to a device for actuating the visors of helmets in general, and in particular motorcyclists' helmets.

With specific reference to motorcyclists' helmets, provided with built-in visors, these (visors) must be easy to turn over in order to expose the helmet's aperture and must be capable of being positioned, in addition to the closed and fully open position, in all positions intermediate to said limit positions, by means of controls which can be easily actuated by the user with only one hand, this being essential in the specific case of motorcyclists.

This invention maintains firm the principle stated in said patent, according to which the extremities of the visor are hinged to the helmet by slider elements running in suitable guides or ways in said helmet and work in conjuction with a control means through which the operator imparts to the visor a rectilinear motion, at first making accessible the edges of the visor from the ledge of the helmet successively causing the visor to oscillate about the pins of the hinges to free the aperture of the helmet.

This invention relates to improvements intended to shift and secure the visor angularly in a desired position and hold it in said position, in consideration also of the possibility to neutralize, more or less the wind action exerted on the visor while the vehicle is running. These solutions are totally based on the inventive principles set forth in the above-mentioned patent. Specially, the actuating means for the visor are provided with a pinion gear rack assembly one of the elements in which is secured to the helmet structure, the other moveable and operatively linked to the control means of the visor; a hinge is provided, so that by actuating the moveable part of the pinion gear rack assembly, the visor is subjected to rectilinear and successive angular displacement.

The invention will now be explained in the description which follows in conjunction with the attached drawings, which illustrate, only by way of example, some forms of an embodiment of the device as applied on a normal motorcyclists' helmet fitted with a built in visor. In the drawings.

Figure 1:
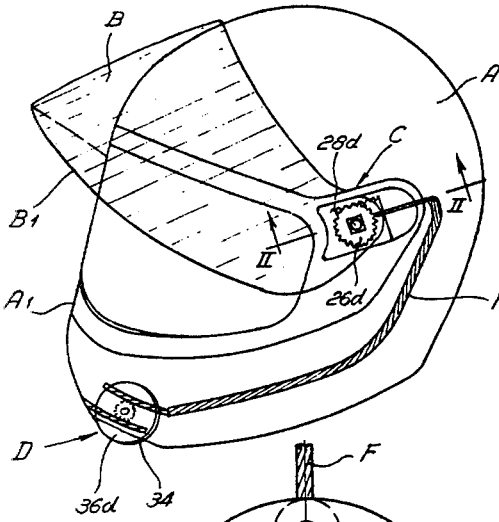
FIG. 1 is a front elevation view of the helmet, fitted with the device according to the invention.

With reference to the figures in the drawing, parts equal or equivalent to those described and illustrated in the said patent are identified by the same symbols specifically, letter A indicates the helmet and letter B the visor, the edge of which B1 runs in a ledge A1 adjacent to the edge of the aperture of the visor while letter C identifies one of the two devices of the visor operatively linked to a single control means D secured in a suitable and convenient position of the helmet, as will be described infra.

Figure 4:
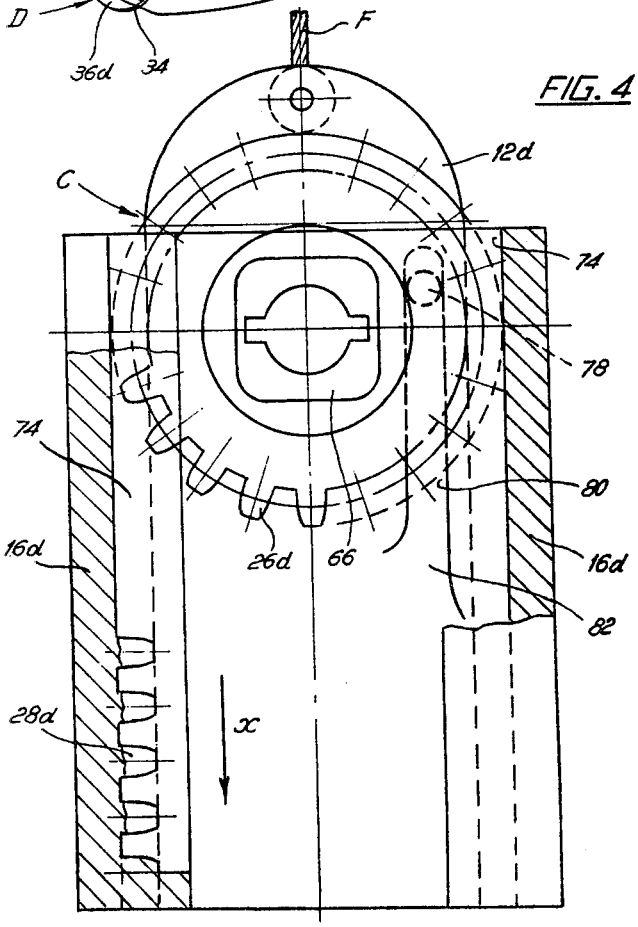
FIG. 4 is a front view of the device shown in FIG. 1, with parts viewed in cross section.
Figure 2:
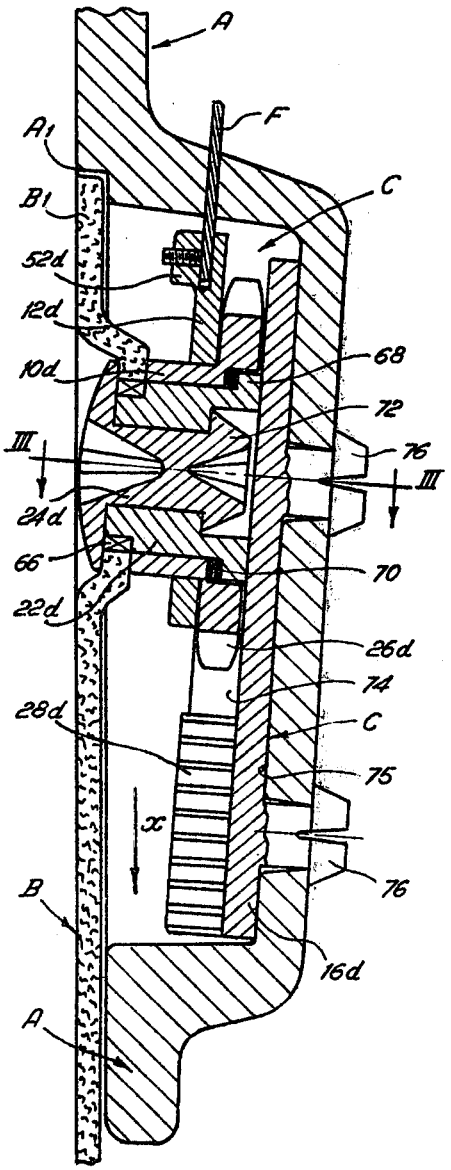
FIG. 2 illustrates, on a larger scale, a horizontal section taken on lines II—II of FIG. 1.

With reference specifically to FIGS. 2 and 4, a bushing **22*d* is secured to each end of visor B, for example, by means of polygonal couplings 66; said bushing terminates at the end opposite to the securing end with a crown 68 which holds flexible gasket 70 in engagement with the ledge of a housing in the hub of pinion 26*d***, forming in this manner, between said parts, a friction coupling as will be explained infra.

A locking means **24*d* engages with the hole in bushing 22*d*; the head of said locking means engages with an annular end of a ledge in visor B to hold this in place during its movements. Said locking means 24*d* may consist of an ordinary screw engaged in the threaded hole of bushing 22*d*; in the case illustrated, locking means 24*d* is of a die cast flexible material, terminating with a head 72 engaging yieldingly with a shoulder piece in bushing 22*d***.

Bushing **10*d* of pinion gear 26*d* forms the other element of hinge 10*d*–12*d* and is rotatably held by a supporting plate 12*d* to form a slider jointly with the pinion, in guides 74, running longitudinally by a plate, and supporting hollow tube 16*d* which, together with the parts forming device C are held in a ledge 75** in the lateral part of helmet A.

Hollow supporting tube **16*d* and hence device C is secured to the wall of helmet A by pins provided with engaging teeth 76 of flexible material in said hollow tube which engage the holes in the bottom wall of ledge 75** of helmet A. It is obvious that these parts may be replaced by equivalent parts such as screws or similar elements.

The plate or hollow supporting tube **16*d* is provided with a rack 28*d* toward one of its ends opposite the bottom wall of one of said guides 74; the plate or hollow tube can thus engage pinion gear 26*d* projecting for a short length from said hollow tube 16*d*, in order to permit assembly 12*d*–26*d* to run in guides 74, at first freely and subsequently to cause engagement of pinion gear 26*d* of the assembly with rack 28 as will be described infra. In order to ensure the required positioning of pinion gear 26*d* during the linear travel determined by assembly 12*d*–26*d*, the pinion is provided, in eccentric positon, with a pin 78 (see pages 3 and 4) engaging with a slot 80 extending lengthwise along the internal part of supporting hollow tube 16*d*. Said groove terminates with an enlarged part 82, close to the initial portion of rack 28*d*. Thus, when pinion gear 26*d* engages said rack, pin 78 disengages from groove 80. The plate of support 12*d* terminates, at its free end, with a clip 52*d* which holds one of the ends of a flexible control means F consisting for example, of a steel wire, Bowden cable or Teleflex cable or similar. Said control means F runs slidably in a suitable sheath, secured to the internal part of helmet A its other end being secured to a manual actuating means D of helmet A in a position easily accessible to the user. The lower edge of helmet A holds, by means of pin 84, a knurled disc 36*d* to which is connected a pinion 85. The teeth of this pinion engage in a diametrically opposite position the other two ends of flexible control means F (pertaining to right hand and left hand actuating devices C in helmet A). Each of the ends 85, in particular in Teleflex cables has a helically wound wire the turns of which form a rack which engages the teeth of pinion 83—of course, said ends may have suitable racks so that by means of the movement of disk 36***a* it is possible to move the two devices C of the visor B—of course, pinion 83 may comprise a rocker, depending on the characteristics of the flexible controls F which are used.

The operating mode of device C is quite evident from the above description. Considering that in FIGS. 2 and 4 of the drawing the device is shown in the condition corresponding to the lowered and retracted position of visor B, i.e. with its edge engaged with ledge A1 of helmet A; to open the visor, the user can act, for example, with the thumb of one hand on the knurled contour of disc 36*d* in order to rotate this. This ensures that the flexible cables F impart to assemblies 12*d*–26*d* of each device C synchronous movements, both in the direction of arrow x in FIG. 2.

Specifically, supporting plates 12*d* are caused to run along guides 74 without causing rotation of pinion gears 26*d* as the latter are held in angular locked position due to the engagement of pins 78 in their respective rectilinear grooves 80.

It follows that visor B is shifted horizontally in the direction of arrow X as shown in FIG. 2 and this movement continues until the teeth of pinion gear 26*d* engage rack 28*d*. In this case, any further movement in the direction of arrow X, causes upward travel of visor B, which is thus moved away from the aperture of the helmet.

As a result of the presence of clutch 70, visor B can be stopped and maintained steadily in any position comprised between the two limit positions, the first being horizontal (at which the visor closes the helmet's aperture) and the other being inclined (at which the helmet's aperture is fully open).

The action of clutch 70 on visor B constantly ensures required positioning of the visor, even in the presence of strong wind, since it is possible to vary the action of said clutch 70 by providing it with suitable adjusting means apt to modify the braking action on the visor B. Furthermore, the action of the clutch can be modified and controlled to provide automatic closing of the visor, utilizing the wind thrust when said visor is in a position close to its closed position.

In order to facilitate operation of visor B, the two devices C are secured to helmet A by orienting the bottom of ledges 75 so as to incline these conveniently with respect to the vertical medium line of helmet A and to diverge them frontally and outwardly with respect to the helmet. This arrangement facilitates the turning over of visor B as it is sufficient to impart to it a slight rectilinear movement to disengage its edge from ledge A with consequent overturning.

It is evident that by actuating knurled ring 36*d* in a direction opposite to that previously considered, the above mentioned movements occur in reverse succession so that visor B is lowered and caused to re-enter into ledge A of the helmet.

Figure 5:
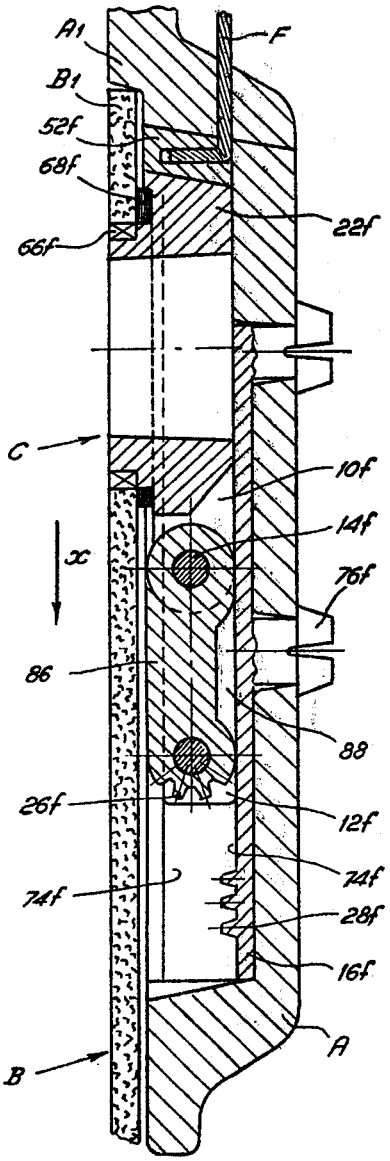
FIGS. 5 and 6, are similar respectively to FIGS. 2 and 4 and show a variation of the device.
Figure 3:
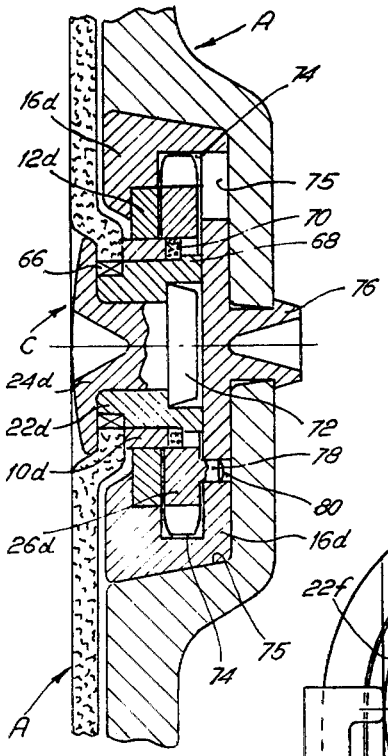
FIG. 3 is a vertical cross sectional view on lines III—III of FIG. 2.
Figure 6:
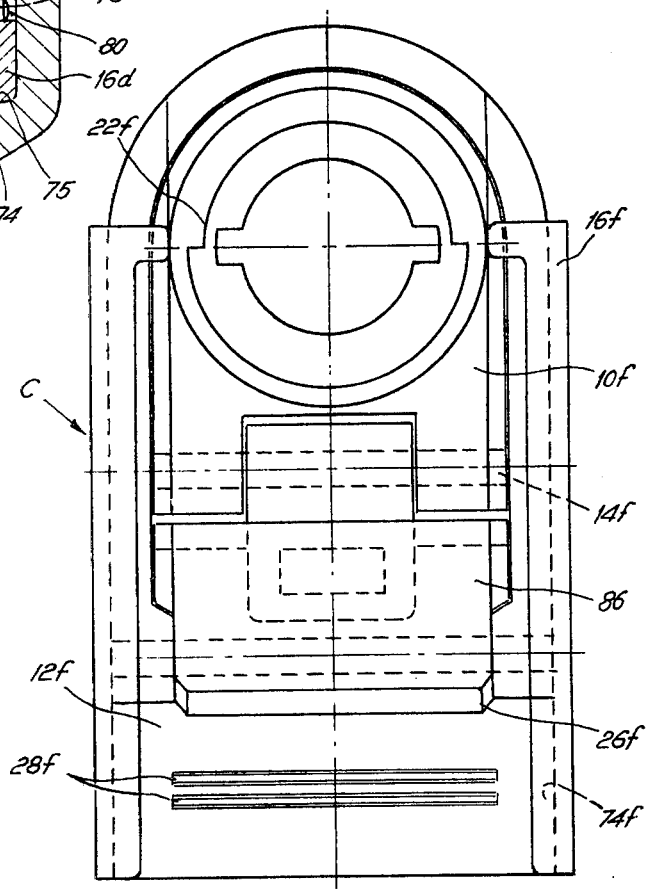

FIGS. 5 and 6 of the drawings represent a simplified version of the device according to the invention, similar to that illustrated in FIGS. 2 and 3 of the cited patent. In this version, the plate or hollow tube 16*f* is provided with guides 74*f* for supporting plate 12*f*, also shaped as a bracket between the arms of which freely runs bushing 22*f*, bound to visor B by clutch 68*f*.

Supporting plate 22*f* holds a hinged connecting rod 84 which holds, by means of pin 14*f*, (through complementary plate 10*f*) bushing 22*f* for visor B.

Connecting rod 86 is provided at its free end with teeth 26*f* formed by a pinion gear which engages (as will be described infra), a toothed rack 28*f* in the bottom wall of hollow tube 16*f*. Said wall is also provided, in a suitable position, with a prong 88 shaped as an inclined plane and which can engage with the side end of connecting rod 86*f*.

Plate 22*f* terminates with a clip 52*f* for control cable I, connected to control means D as shown in FIG. 1.

Also in this case, operation of disc 36*d* causes assembly 22*f*–86 to shift in the direction of arrow x, and teeth 26*f* connecting rod 86 to engage rack 28*f*, whilst the other end of said connecting rod 86 also engages clip 88. It follows that bushing 22*f* and end $B_1$ of visor "B" become disengaged from the housing in hollow tube 16*f*, while the successive engagement of teeth 26*f* with rack 28*f* completes the disengagement of the edge of the visor from ledge "A" on the contour of the helmet's opening.

The user then completes lifting of visor B by acting on it directly or utilizing wind action to orient the visor conveniently on the helmet.

It is understood that modifications may be introduced in the device depending on requirements; for example pinion gear rack 26*d*–28*d* assembly can be substituted equivalently by a cam or eccentric, the contour of which engages on or more projections on supporting hollow tube 16*d* to impart to visor B, (following a rectilinear displacement), also an angular displacement around bush 22*d*. Control of slider 12*d* can be effected either by means of a fluid under pressure or by means of a piston cylinder assembly. Moreover, supporting hollow tube 16*d* can be located in the structure of helmet A itself, it being evident that this and other changes will not affect nor depart from the spirit and protective coverage of this patent.

I claim:

1. A device for actuating a visor of a helmet, said helmet having a front aperture bounded by a ledge for housing the peripheral portion of said visor comprising:

first and second hinges connected to support said visor for angular rotation and linear motion into and out of communication with said ledge;

first and second guides located on opposite sides of said helmet;

first and second pinions connected to rotate said hinges and visor, said pinions being located within said guides;

first and second slide elements connected to each of said pinions for linearly displacing said pinions whereby said visor is linearly moved away from said helmet ledge;

first and second racks disposed within said guides for engaging said pinions when said visor has been displaced from said helmet ledge whereby said visors are angularly displaced by continued linear movement of said pinions; and p1 a control element for linearly displacing said slide elements within said guides whereby said visor is linearly displaced to and from said ledge and angularly rotated.

2. A device according to claim 10 characterized in that guides for said sliders extend for a length greater than the length of teeth of said rack when said visor (B) is lowered and its edge is housed in said ledge of the helmet.

3. A device according to claims 1 or 2, characterized in that the pinion has in an eccentric position a pin which engages with a slot extending for a tract of limited length in parallel with said guides and which substantially terminates at one end of said racks with a larger tract for disengaging said pin when the rack and pinion mesh.

4. A device according to claim 1 characterized in that a pinion gear is provided in an end of a connection rod hinged to an end of a slider and which holds, through a pin plate supporting a bushing for the visor.

5. A device according to claim 4 characterized in that said guides toward their ends, have a prong to engage ends of said connecting rod and to disengage an edge of the visor from said ledge of the helmet.

6. A device according to claim 1, 2, 3, 4 or 5, characterized in that it has clutch gaskets interposed between the hinges for the visor and said pinions.

7. A device according to claim 1, 2, 3, 4 or 5, characterized in that the racks and guides are provided in a supporting plate which may be secured to the structure of said helmet.

8. A device according to claim 1, 2, 3, 4 or 5, characterized in that a control means of flexible means operatively connects said sliders to toothed rods cooperating with a pinion secured to an actuating button fitted rotatably in the helmet's body.

9. A device for actuating a visor of a helmet, said helmet having a front aperture bounded by a ledge for housing the peripheral portion of said visor comprising:

hinges connecting first and second portions of said helmet by means of pins, said pins permitting angular rotation of said visor when said visor periphery is displaced from said ledge;

first and second guides located on said helmet for supporting said hinges;

first and second slides located in said guides for linear motion therein;

an assembly of a rack and pinion located in each of said guides, one of said rack and pinion being connected to a slider the remaining of said rack and pinion being fixed with respect to said helmet, said rack and pinion being engaged only during a portion of the travel of said slides;

means for imparting a motion to said sliders displacing said visor away from said helmet followed by rotation of said visor as said rack and pinion engages.

10. A device according to claim 1 or 9, further comprising a clutch connected between said hinges and pinions restricting the angular displacement of said visor.

11. A device according to claims 1 or 9, further comprising means for inhibiting rotation of said pinions when said pinions are free of said racks.

12. A device for actuating a visor of a helmet, said helmet having a front aperture a portion thereof being bounded by a ledge for housing an edge of said visor comprising:

first and second hinges connected to said visor;

first and second tracks on said helmet for supporting said hinges for linear motion whereby said visor edge is permitted to move into and out of said ledge;

a control element for providing linear motion to said hinges; and means for imparting an angular rotation to said hinges when said visor has been displaced from said ledge in response to continued linear movement of said hinges in said tracks.

* * * * *